US008689884B2

(12) United States Patent
Young et al.

(10) Patent No.: US 8,689,884 B2
(45) Date of Patent: Apr. 8, 2014

(54) MUD PULSE TELEMETRY SYSTEM

(75) Inventors: Allen Young, Houston, TX (US); Michael M. Meadows, Cypress, TX (US); James Huber, Pearland, TX (US); Laura Fore, Conroe, TX (US)

(73) Assignee: Multishot LLC, Conroe, TX (US)

( * ) Notice: Subject to any disclaimer, the term of this patent is extended or adjusted under 35 U.S.C. 154(b) by 732 days.

(21) Appl. No.: 12/682,553

(22) PCT Filed: Sep. 8, 2008
(Under 37 CFR 1.47)

(86) PCT No.: PCT/US2008/075577
§ 371 (c)(1),
(2), (4) Date: Oct. 11, 2010

(87) PCT Pub. No.: WO2009/033146
PCT Pub. Date: Mar. 12, 2009

(65) Prior Publication Data

US 2011/0011594 A1 Jan. 20, 2011

Related U.S. Application Data

(60) Provisional application No. 60/970,736, filed on Sep. 7, 2007.

(51) Int. Cl.
*E21B 34/06* (2006.01)
*E21B 47/18* (2012.01)

(52) U.S. Cl.
CPC ..... *E21B 47/18* (2013.01)
USPC ..... 166/373; 166/320; 166/321; 175/48

(58) Field of Classification Search
USPC ..... 166/373, 320, 321, 250.07; 175/48; 367/84, 85; 340/854.3
See application file for complete search history.

(56) References Cited

U.S. PATENT DOCUMENTS 4,297,880 A * 11/1981 Berger ..... 73/152.22
6,469,637 B1 10/2002 Seyler et al.
2005/0260089 A1* 11/2005 Hahn et al. ..... 417/505

FOREIGN PATENT DOCUMENTS

WO 02/29441 A1 4/2002
WO 2005/005778 A1 1/2005

OTHER PUBLICATIONS

International Search Report and Written Opinion for PCT/US2008/075577 mailed Apr. 8, 2010.

* cited by examiner

*Primary Examiner* — Cathleen Hutchins
(74) *Attorney, Agent, or Firm* — Winstead PC

(57) ABSTRACT

A mud pulser tool to be positioned into a downhole environment is disclosed. The mud pulser tool includes a control valve that is selectively opened to allow fluid to flow through the mud pulser tool or selectively closed to restrict the fluid flow, wherein the control valve is selectively opened or closed to produce a mud pulse signal transmitted through the fluid. The mud pulser tool also includes a sensor system to measure a pressure drop across the control valve. In one example, the mud pulser tool includes a control system to selectively open or close the control valve to adjust the pressure drop to produce a selected pressure drop across the control valve.

19 Claims, 8 Drawing Sheets

MUD PULSE TELEMETRY SYSTEM

FIELD OF THE INVENTION

The present invention relates generally to measurement while drilling, and, more specifically, to mud pulser devices.

BACKGROUND

Measurement while drilling (MWD) involves evaluating the physical properties of the well environment in three-dimensional space while extending a wellbore. MWD is now standard practice in many drilling operations and usually involves digitally encoding data and transmitting this data to the surface as pressure pulses in the mud system.

A mud pulser periodically constricts the flow of drilling fluid inside the drill pipe to generate meaningful pressure pulses which are then transmitted to the surface. The data conveyed by these pulses is embodied in the temporal pattern of the pulses. These measurements include downhole temperature, pressure, near-bit spatial attitude as measured by inclination and azimuth, gamma ray count rate and other parameters.

Because of the fluid signal attenuation over a given length of drill pipe, a minimum pressure pulse height must be generated downhole for each specific set of well conditions in order for the pulses to be detected and decoded at the surface. In other words, the pressure drop across the mud pulser affects the ability of the mud pulser to create meaningful pressure pulses. Conventional methods of providing selected pressure pulse amplitudes typically require manually changing the diameters of the poppet and orifice components that constrict flow within the mud pulser tool. This conventional approach lacks precision, is time consuming and often leads to job failure due to improper sizing. Accordingly, there is a need for providing a mud pulser device that automatically adjusts to a selected pressure drop.

SUMMARY OF THE INVENTION

In view of the foregoing and other considerations, the present invention relates to a system and method for closed loop control of the pressure drop across a mud pulser.

Accordingly, a mud pulser tool to be positioned into a downhole environment is disclosed. The mud pulser tool includes a control valve that is selectively opened to allow fluid to flow through the mud pulser tool or selectively closed to restrict the fluid flow, wherein the control valve is selectively opened or closed to produce a mud pulse signal transmitted through the fluid. The tool also includes a sensor system to measure a pressure drop across the control valve. In one example, the mud pulser tool includes a control system to selectively open or close the control valve to adjust the pressure drop to produce a selected pressure drop across the control valve.

A system for closed loop control of a mud pulser pressure drop is disclosed. The system includes a mud pump to pump drilling mud into a downhole environment and a mud pulser tool to be positioned within the downhole environment. The mud pulser tool includes a control valve that is selectively opened to allow the drilling mud to flow through the mud pulser tool or selectively closed to restrict the drilling mud flow, and a sensor system with pressure sensors to continuously measure a pressure drop across the control valve while the mud pulser tool is positioned within the downhole environment. In one example, the system includes a control system to selectively open or close the control valve to adjust the pressure drop to produce a selected pressure drop across the control valve to transmit a selected mud pulse signal. The system also includes a surface receiver device to receive the selected mud pulse signal.

A method for mud pulse telemetry is disclosed. The method includes the steps of: positioning a mud pulser tool comprising a flow restriction mechanism into a downhole environment; circulating fluid through the downhole environment for a first period of time; measuring pressure upstream of a flow restriction mechanism during the first period of time; measuring pressure downstream of the flow restriction mechanism during the first period of time; and obtaining a first differential pressure measurement. In one example, the method also includes adjusting the flow restriction mechanism to achieve a selected differential pressure.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific example of the invention, when read in conjunction with the accompanying drawings, wherein.

DETAILED DESCRIPTION

Figure 1:
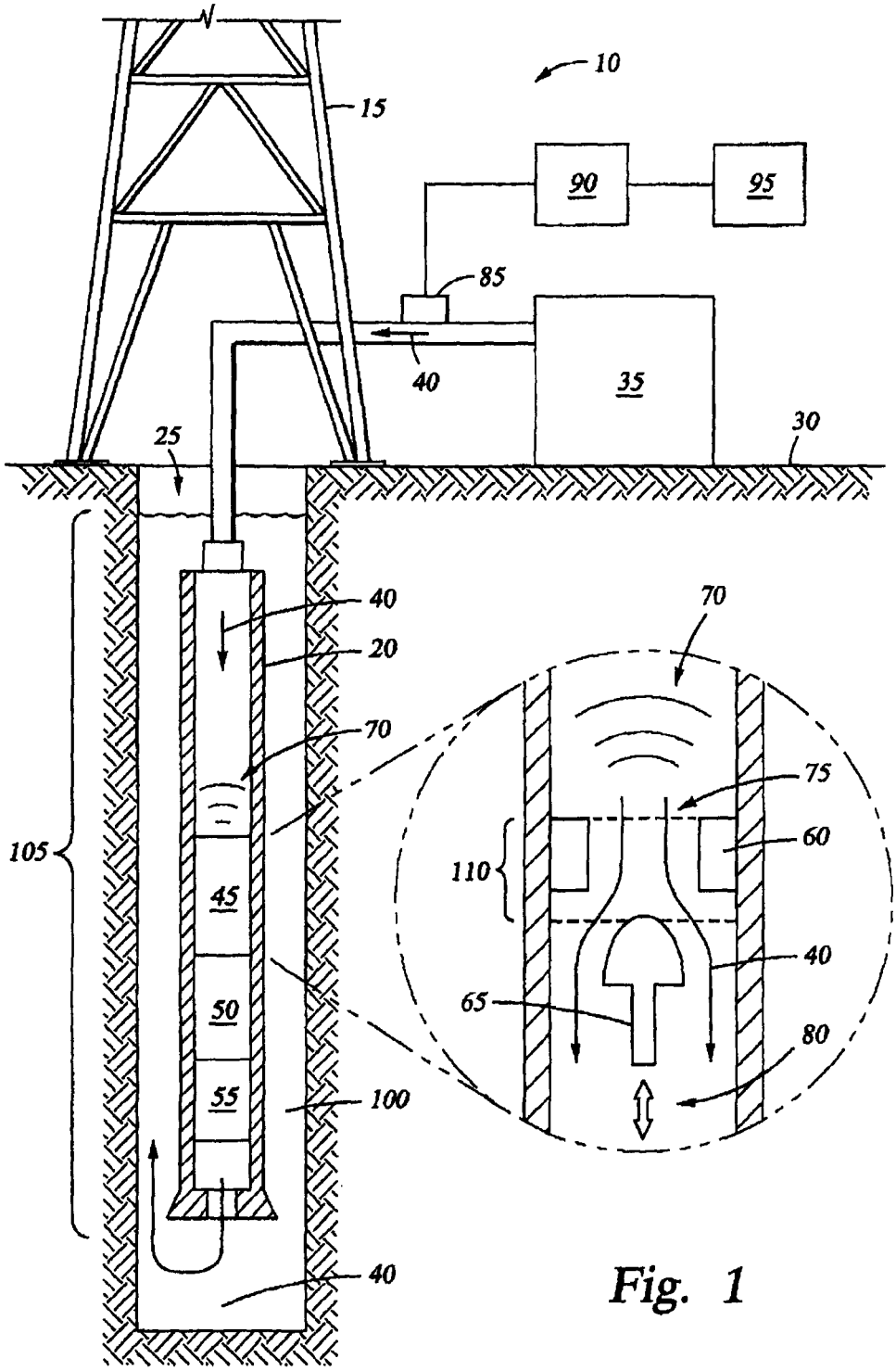
FIG. 1 is a schematic of an example of the presently disclosed mud pulse telemetry system.

Refer now to the drawings wherein depicted elements are not necessarily shown to scale and wherein like or similar elements are designated by the same reference numeral through the several views.

As used herein, the terms "up" and "down"; "upper" and "lower"; "upstream" and "downstream"; "uphole" and "downhole"; and other like terms indicating relative positions to a given point or element are utilized to more clearly describe some elements of the examples of the invention. Commonly, these terms relate to a reference point as the surface from which drilling operations are initiated as being the top point and the total depth of the well being the lowest point.

The disclosed system and method provides real-time or automatic measurement of the pressure drop across the control valve of a mud pulser tool. The mud pulser tool may then configure the control valve to change the current pressure drop to produce a selected pressure drop to generate a mud pulse signal that is strong enough to be detected and decoded at the surface.

In another example, the system or mud pulser tool automatically adjusts to a selected pressure drop based on depth or other downhole conditions, to allow a detectable mud pulse amplitude to be automatically obtained over a wide range of drilling depths, drilling fluid flow rates, densities, viscosities, and other downhole conditions or parameters. Accordingly, as the depth of the downhole environment increases, the present invention may adjust the target pressure drop to ensure that pressure pulses are still detected and decoded at the surface.

In some examples, the mud pulser tool also comprises a threadless, bayonet-assembly based sonde design to allow for relatively inexpensive fabrication and low maintenance. For example, the mud pulser tool may comprise non-threaded sonde subassemblies that are secured by a retainer into a single housing or collar.

FIG. 1 is a schematic of an example of the disclosed mud pulse telemetry system, indicated generally by 10. System 10 comprises a closed loop circulating system, or any other system suitable for transmitting data via mud pulse telemetry. System 10 includes drilling rig 15 operable to suspend or position tool 20, which may be part of a drill string, within wellbore 25 located within earth formation 30 at a selected depth 105. System 10 or drilling rig 15 includes mud pump system 35 to pump drilling mud 100 along mud flow direction 40 through system 10. System 10 includes one or more surface devices 95, which may include a computer system or other central, data storage and processing location for digital mud pulse telemetry data. Surface device 95 receives data from tool 20 and may transmit data or instructions to tool 20 or other components of system 10 via wired or wireless connections, pressure pulses or similar means.

Tool 20 may be any tool operable to use fluid (e.g., liquid or gas) pressure pulses to convey digital information. For example, tool 20 may be a measurement while drilling (MWD) tool, logging-while-drilling (LWD) tool, or similar mud pulse telemetry equipment. Tool 20 includes a control valve or mud pulser system 45, drive system 50, and sensor and electronics system 55. Mud pulser system 45 includes orifice system 60 and poppet system 65 to selectively restrict mud flow 40 within tool 20 to generate mud pulse signal 70. Mud pulser system 45 selectively positions poppet system 65 with respect to orifice system 60 to selectively block or open orifice system 60 to achieve a desired differential pressure across mud pulser system 45. For example, mud pulser system 45 may selectively adjust the spacing 110 between orifice system 60 and poppet system 65.

Sensor and electronics system 55 detects the pressure across mud pulser system 45 to determine the differential pressure or pressure drop. For example, sensor and electronics system 55 may determine the pressure upstream and downstream of mud pulser system 45 at locations 75 and 80, respectively. This data may be relative or hydrostatic pressure based on gauge or absolute measurements. Using the upstream pressure (P1) and downstream pressure (P2) measurements, sensor and electronics systems 55 may then calculate the differential pressure, P1-P2, for a give depth. By measuring differential pressure instead of a single pressure reference, tool 20 may minimize the effects of noise, such as that caused by pressure fluctuations of pump pistons. Sensor and electronics system 55 may be programmed or instructed via surface device 95, for example, to conduct the pressure drop measurements automatically, at selected time intervals, or under selected conditions. Sensor and electronics system 55 also includes sensors operable to determine selected properties of formation 30, wellbore 25, drilling mud 100, or other sections of the downhole environment. For example, sensor and electronics system 55 may include mud density sensors. Tool 20 then transmits this data via mud pulser system 45 as mud pulses 70. Sensor and electronics system 55 may receive data or instructions from surface device 95. For example, tool 20 may receive timed or encoded pressure pulses from surface device 95. Sensor and electronics system 55 may include wireless transmitters and receivers to allow wireless communication between tool 20 and surface device 95, or other components of system 10.

Drive system 50 is coupled to mud pulser system 45 to generate a selected pressure drop across mud pulser system 45 regardless of drilling fluid flow rate, viscosity, density, or other downhole conditions. Drive system 50 receives instructions from sensor and electronics system 55 (or may receive instructions from surface device 95, for example) to adjust the configuration of mud pulser system 45 based on the optimal or selected pressure drop. Drive system 50 may include any suitable motor or servo. For instance, drive system 50 may include an oil-immersed, brushless DC motor (BLDC) such as a three-phase AC synchronous motor, stepper motor, or reluctance motor, for example.

During operation, mud pump system 35 pumps drilling mud 100 along mud flow direction 40 into tool 20. Mud pulser system 45 receives and selectively restricts mud flow 40 to generate mud pulse signal 70. System 10, in response to the signal-to-noise ratio and/or the downhole conditions, selects a pressure drop across mud pulser system 45 to provide a sufficient mud pulse signal 70 to reach the surface to be decoded, but not too much pressure that may result in damage to tool 20, pumps 35, or other equipment, excessive cavitation downhole, or other undesirable conditions. The target pressure drop may be selected based on depth 105, hydrostatic pressure, mud weight, desired surface pulse height, and the pressure drop for a fully open control valve 45, among other factors.

For example, the target pressure drop (Target dP) may be based on the absolute pressure reading:

$$\text{Depth (ft)}=19.25\times\text{Hydrostatic Pressure (p.s.i.)}/\text{Mud Weight (p.p.g.)} \quad (1)$$

Assuming an assuming an average standpipe pressure of 2000 p.s.i., and an average mud weight of 11 lb./gal., the approximate depth 105 may be expressed as:

$$\text{Estimated Depth (ft.)}=19.25\times(\text{Pressure (p.s.i.)}-2000)/11\ \text{p.p.g.; or} \quad (2)$$

$$\text{Estimated Depth (ft.)}=1.75\times\text{Pressure (p.s.i.)}-3500 \quad (3)$$

In this example, the desired pulse height is about 60-100 p.s.i., with a goal of about 80 p.s.i. The relation of downhole pressure drop to surface pressure rise may be approximated as shown below:

$$\text{Depth}\leq 2000\ \text{ft.: Pulse height at surface (p.s.i.)}=(\Delta dP\ \text{across tool})/2 \quad (4)$$

$$\text{Depth}>2000\ \text{ft.: Pulse height at surface (p.s.i.)}=\Delta dP\ \text{across tool}/(\text{Depth (ft.)}/1000) \quad (5)$$

The formula for the desired differential pressure across the tool (Target dP) may be expressed as:

$$\text{Target dP}=\text{Full Open dP}+\Delta dP \quad (6)$$

$$\text{Absolute pressure}\leq 3140\ \text{p.s.i.: Target dP}=\text{Full Open dP}+160 \quad (7)$$

$$\text{Absolute pressure}>3140\ \text{p.s.i.: Target dP}=\text{Full Open dP}+((0.14\times\text{Pressure})-280) \quad (8)$$

where full open dP is the pressure drop across the open control valve 45, and pressure is the measured absolute pressure of the downhole environment (p.s.i.) at the current depth 105.

System 10 may continuously measure the in-situ, real time pressure drop and automatically provide adjustments to achieve the selected pressure drop. During no-flow periods, system 10 may measure the absolute pressure to estimate depth 105. The determination or estimation of depth 105 may be based on an analysis of absolute pressure history or density measurements. Alternatively, or in addition, system 10 may estimate depth 105 during flow periods based on pump pressure and hydrostatic pressure. Based on the estimated depth, system 10 may then determine the optimal characteristics of mud pulse signal 70, such as a pulse height, necessary to provide adequate data transmission at a safe level of pressure. Tool 20 or surface device 95 may determine the required signal characteristics based on a pulse height selection algorithm or lookup table.

In addition, sensor and electronics system 55 may include sensors to make real time measurements of mud density. With the mud density data, tool 20 may determine the mud flow rate in-situ using the pressure drop across the control valve 45 based on an orifice meter equation. As a result, system 10 may provide a fully-characterized ability to adjust in real-time for several factors, e.g., flow rate, mud density, and depth. Accordingly, the pressure drop may be selected and adjusted to ensure that mud pulse signal 70 is strong enough to be transmitted to the surface and decoded as the depth 105 of wellbore 25 increases without causing damage to the components of system 10 or causing other undesirable conditions. Accordingly, system 10 may provide closed loop control of the pressure drop across tool 20.

Surface pressure transducer 85 receives mud pulse signal 70 and transmits the signal to receiver 90. Receiver 90 then transmits signal 70 to surface device 95. Surface device 95 decodes signal 70 to extract the sensor data transmitted via mud pulse signal 70. Surface device 95 may provide storage, processing and transmission of this data. Accordingly, system 10 may acquire and transmit data via mud pulse telemetry across a wide range of downhole conditions without the need for manual readjustment of downhole mud pulse telemetry equipment.

Figure 2:
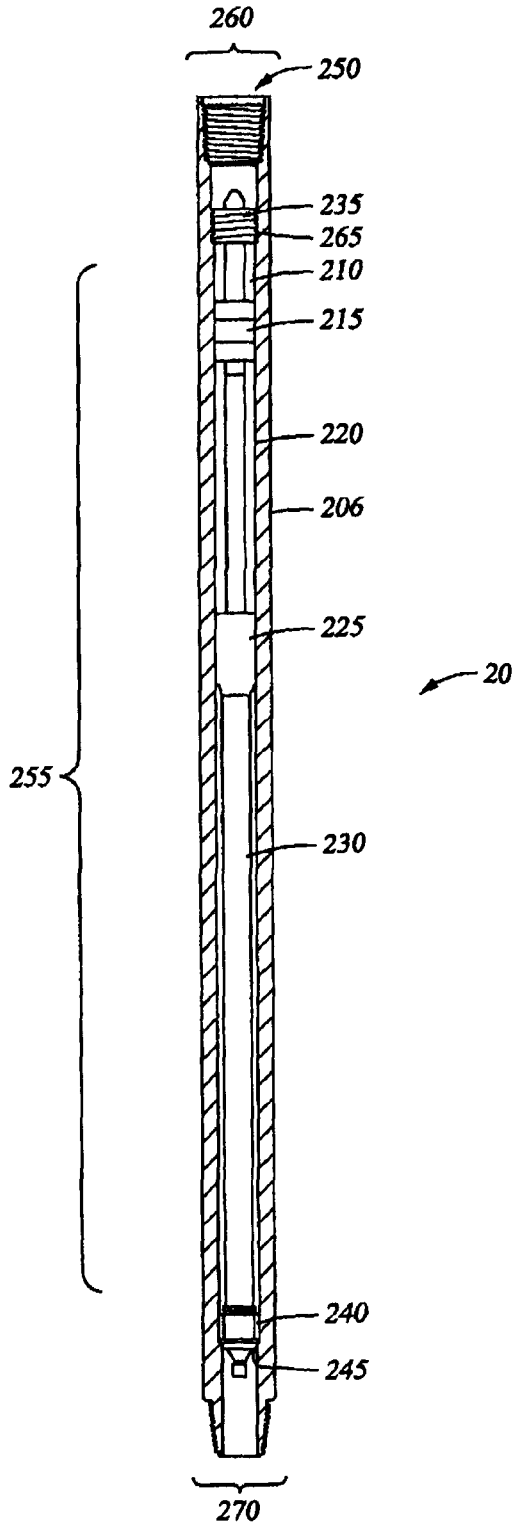
FIG. 2 shows an example of the mud pulser tool shown in FIG. 1.

FIG. 2 shows mud pulser tool 20 in more detail. Tool 20 automatically achieves a selected mud pulser pressure drop by continuously measuring pressure both upstream and downstream of the poppet/orifice flow restriction mechanism, and then adjusting the spacing or gap between the poppet and orifice until the desired differential pressure is achieved. Tool 20 is therefore able to generate meaningful pressure pulses across a wide range of depths and downhole conditions.

As shown in FIG. 2, tool 20 includes a modular design in which a substantially non-threaded, bayonet-assembly, sonde-based MWD tool string is secured via compression. Tool 20 comprises a substantially cylindrical collar or housing 205 having a central cavity 250 to house sonde 255. Housing 205 may also include inner lip 245 and threading 265, positioned within central cavity 250.

Sonde 255 includes upper pressure port assembly 210, orifice assembly 215, pulser motor assembly (PMA) 220, pressure transducer assembly 225, and electronics package 230. Modules 210, 215 220, 225 and 230 are threadless. During preparation of tool 10 for a downhole operation, each of these modules 210, 215, 220, 225, and 230 may be mechanically coupled or stabbed together to form sonde 255 without requiring the modules to be individually threaded together. When coupled or stabbed together, the modules 210, 215, 220, 225, and 230 are also electrically and/or hydraulically coupled without requiring individual connections to be separately made between the modules. Modules 210, 215, 220, 225, and 230 may connect in a manner that substantially prevents relative rotation between two given modules. For example, the modules may include connections via dowl pins or be shaped to provide a dovetail connection.

Sonde 255 is inserted into housing 205 via cavity opening 260 and positioned against lower support 240. Lower support 240 may mate with and shoulder against lip 245 to support sonde 255 within central cavity 250. Retainer 235 may then be coupled to sonde 255 and/or housing 205 to secure sonde 255 within housing 205. Retainer 235 may include a threaded end-nut, a castle nut or similar fastening device. As retainer 235 is fastened or threaded to threading 265 of housing 205, retainer 235 compresses sonde 255 against lip 245 to secure sonde 255 within housing 205.

Figure 3:
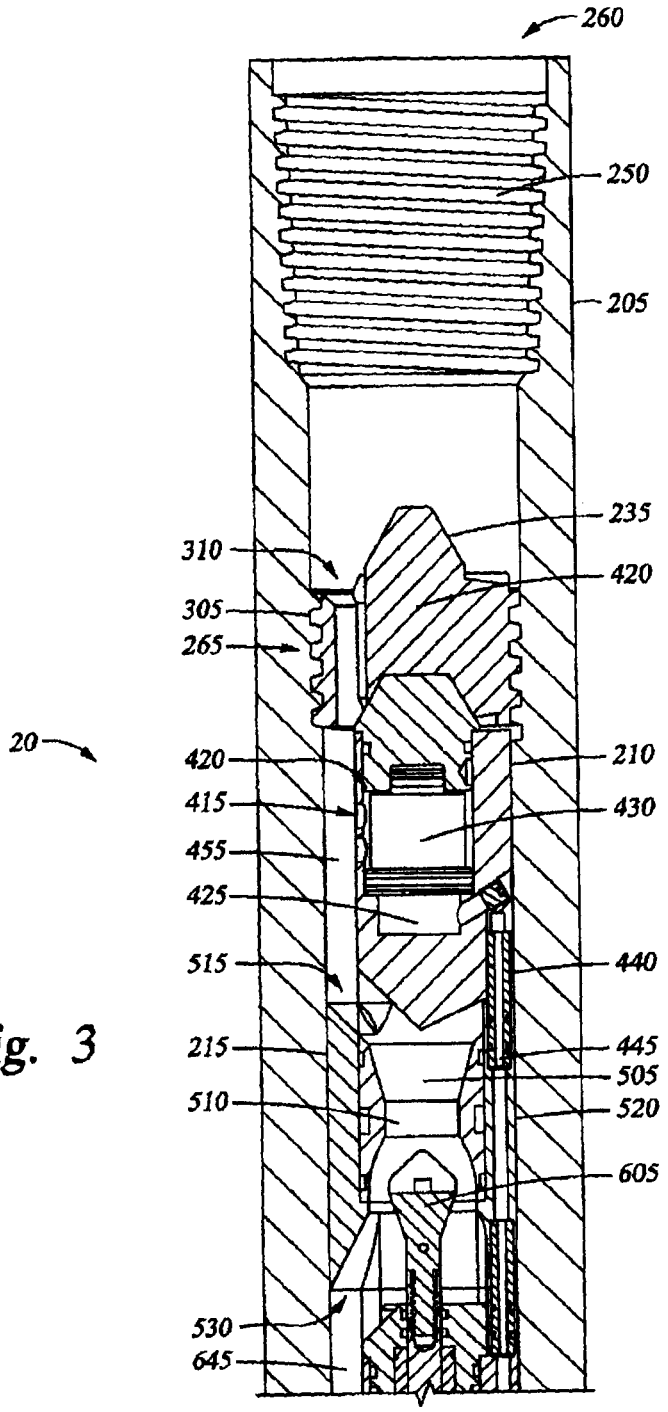
FIG. 3 shows the retainer, upper pressure port, and orifice assembly of the mud pulser tool of FIG. 2.

FIG. 3 shows retainer 235, upper pressure port assembly 210 and orifice assembly 215. Retainer 235 may comprise threading 305 to couple with the interior threading 265 of central cavity 250. Retainer 235 may comprise one or more ports or apertures 310 to allow mud 100 that flows into central cavity 250 to continue to flow through tool 20 to upper pressure port assembly 210 and orifice assembly 215.

Upper pressure port assembly 210 allows tool 20 to determine the pressure upstream of orifice assembly 215. Upper pressure port assembly 210 includes a first port cavity 420 and second port cavity 425. Upper pressure port assembly 210 includes one or more pressure ports 415 to allow drilling mud 100 to enter first port cavity 420. Upper pressure port assembly 210 includes a pressure sensing membrane or diaphragm 430 of a suitable material, such as hydrogenated nitrile butadiene rubber (HNBR). Diaphragm 430 may be positioned proximate to first port cavity 420 and second port cavity 425. Second port cavity 425 may be filled with a selected hydraulic fluid, such as silicon oil, suitable for transmitting pressure information from module 210 to module 225 via hydraulic channel 445. Accordingly, upper pressure port assembly 210 may allow measurement of pressure above the orifice/poppet flow restrictor 215 (e.g., upstream pressure) and transmit the pressure information to downstream components of tool 20. Upper pressure port assembly 210 provides one or more channels 455 between ports 310 and orifice assembly 215 to allow the flow of mud 100 and transmission of mud pulses 70 (not shown in FIG. 3).

Modules 210, 215, 220 and 225 provide sections of, or connections to, hydraulic channel 445, which hydraulically couples upper pressure port 210 and pressure transducer assembly 225 (not shown in FIG. 3). Upper pressure port assembly 210 includes hydraulic channel fitting 440 to hydraulically couple second port cavity 425 and hydraulic channel 445 and to allow hydraulic channel 445 to be coupled between upper pressure port assembly 210 and orifice assembly 215. During assembly of sonde 255, assembly 210 and assembly 215 may be stabbed or coupled together (e.g., without requiring threading) to provide a connection between hydraulic channel fitting 440 and hydraulic channel fitting 520.

Orifice assembly 215 is sized to accept poppet 605 from pulser motor assembly 220 to form the control valve of tool 20. Orifice assembly 215 includes chamber 505, orifice 510, and channels 515 and 530. Orifice 510 couples with poppet 605 to restrict mud flow though orifice assembly 215. When orifice assembly 215 is in a substantially open position, drilling mud 100 may flow from channel 455, through channel 515, through chamber 505, through channel 530 and into channel 645. Poppet 605 may be selectively positioned with respect to orifice 510 to selectively restrict this mud flow to provide mud pulse 70 (not shown in FIG. 3). Orifice assembly 215 includes hydraulic channel fitting 520 to provide another section of hydraulic channel 445.

Figure 4:
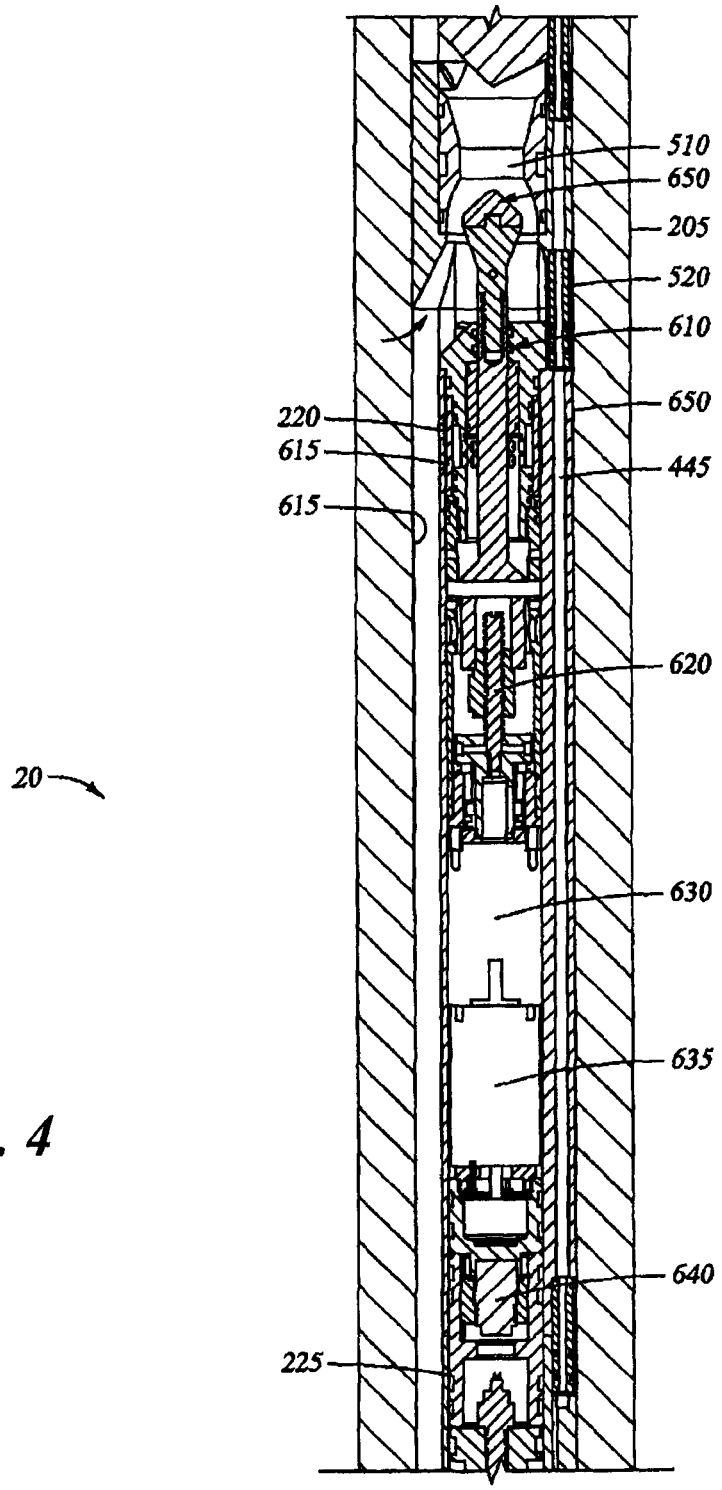
FIG. 4 shows the motor assembly of the mud pulser tool of FIG. 2.

FIG. 4 shows pulser motor assembly 220, which includes poppet 605, poppet push rod 610, compensation bladder 615, ballscrew assembly 620, gearhead 630, motor 635, and electrical connector 640. Poppet 605 may be carbide tipped. Motor 635 may include a brushless DC motor (BDCM), or similar device. Electrical connector 640 may provide a high-pressure (e.g., about 20,000 p.s.i.) electrical connection path between motor assembly 220 and other modules, such as pressure transducer assembly 225 and/or electronics package 230 (not shown in FIG. 4). Gearhead 630, e.g., a planetary gearhead, converts torque from motor 635 to ballscrew assembly 620. Ballscrew assembly 620 provides linear motion to poppet push rod 610 to move poppet 605. Motor assembly 220 may be oil-filled or buffered (e.g., include an oil-immersed BDCM 635) and may include compensation bladder 615 to equalize the pressure within motor assembly 220 to ensure that poppet push rod 610 may be properly engaged in high pressure environments. Accordingly, motor assembly 220 selectively positions poppet 605 with respect to orifice 510 to generate a selected pressure drop across the mud pulser mechanism, regardless of drilling fluid flow rate, viscosity, density, or other downhole conditions. Motor assembly 220 provides channel 645 to allow mud flow through tool 20. Motor assembly 220 includes hydraulic channel connection 650 to continue hydraulic channel 445. During assembly of sonde 255, orifice assembly 215 and motor assembly 220 may be stabbed or coupled together by inserting hydraulic channel fitting 520 into hydraulic channel fitting 650 which includes a fitting and receptacle counterbore to permit assembly without requiring threading.

Figure 5:
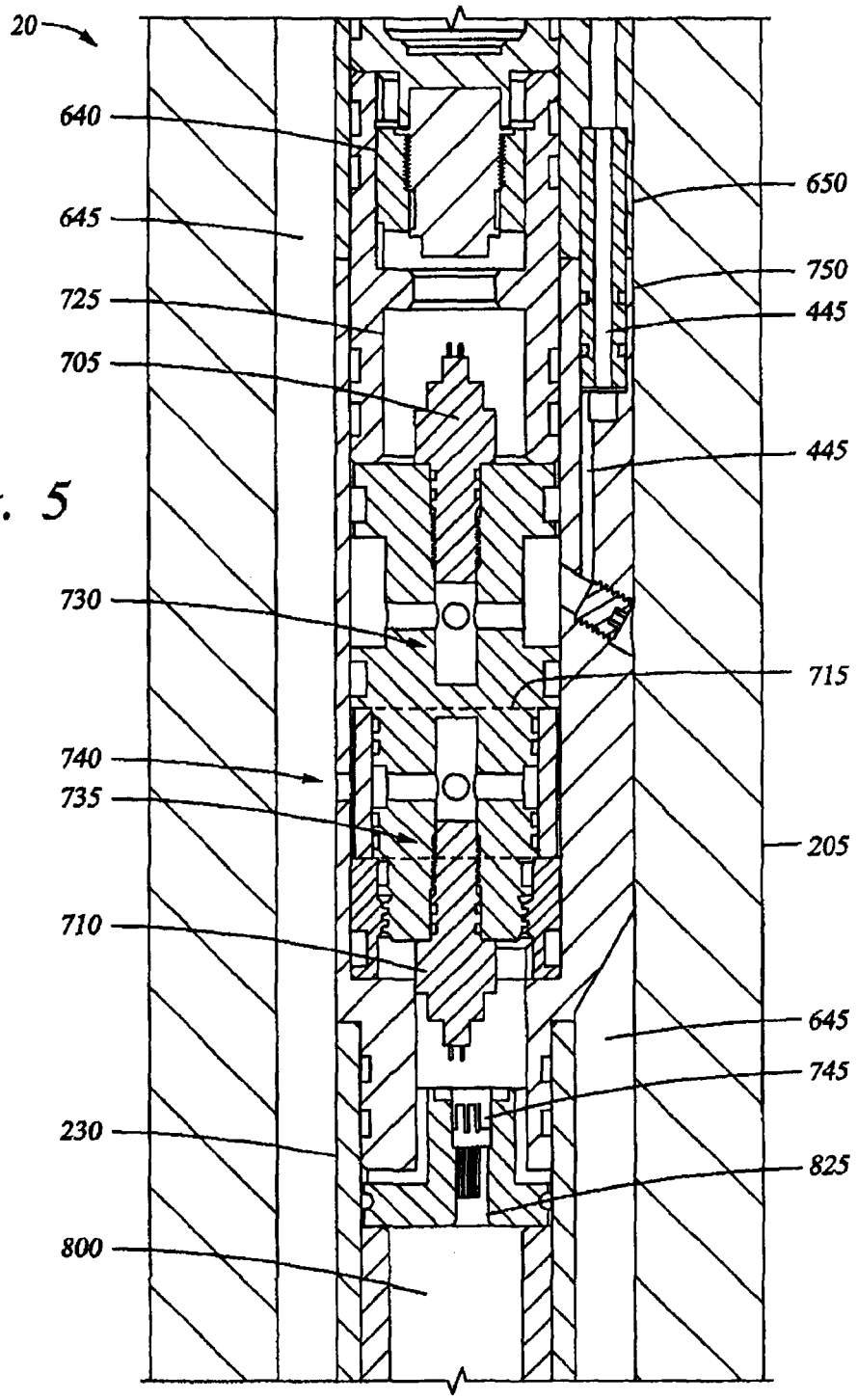
FIG. 5 shows the pressure transducer assembly of the mud pulser tool of FIG. 2.

FIG. 5 shows pressure transducer assembly 225. Pressure transducer assembly 225 includes one or more sensors or transducers to detect the pressure drop for tool 20. As shown in FIG. 5, pressure transducer assembly 225 includes upstream pressure transducer 705 and downstream pressure transducer 710. Pressure transducer assembly 225 may include any suitable pressure transducer, e.g., a differential transducer and an absolute transducer, or a pair of absolute transducers. Pressure transducer assembly 225 includes pressure sensing membrane or diaphragm 715 (shown in phantom), e.g., a HNBR diaphragm or diaphragm bladder, upstream hydraulic cavity 730, downstream hydraulic cavity 735, and downstream pressure port 740. Upstream hydraulic cavity 730 and downstream hydraulic cavity 735 are filled with a selected hydraulic fluid to provide reference pressures for upstream transducer 705 and downstream transducer 710, respectively, and may be isolated from the downstream environment. Pressure transducer assembly 225 includes interconnect bulkhead 725 to receive an electrical and mechanical connection with pulser motor assembly 220 and electrical connector 745 to provide an electrical connection with electronics package 230. During assembly of sonde 255, motor assembly 220 and pressure transducer assembly 225 are stabbed or coupled together to couple electrical connector 640 to interconnect bulkhead 725, and hydraulic channel connection 650 to hydraulic channel receptor 750.

Pressure transducer assembly 225 includes hydraulic channel receptor 750 to provide a connection to hydraulic channel 445. Accordingly, pressure transducer assembly 225 is hydraulically coupled to upper pressure port assembly 210 via hydraulic channel 445. In particular, upstream hydraulic cavity 730 is hydraulically coupled through hydraulic channel 445, second port cavity 425, and diaphragm 430 to first port cavity 420 (shown in FIG. 3). As a result, upstream transducer 705 determines the upstream pressure by measuring the relative pressure of upstream hydraulic cavity 730.

Downstream pressure cavity or port 740 receives mud 100 via channel 645. Downstream transducer 710 determines the downstream pressure by measuring the relative pressure of downstream hydraulic cavity 735. Accordingly, the difference between the measurements from upstream transducer 705 and downstream transducer 710 allows for the determination of the pressure drop for tool 20. The measurements from transducers 705 and 710 may be transmitted to electronics package 230 and/or surface device 95, not shown in FIG. 5.

Figure 6A:
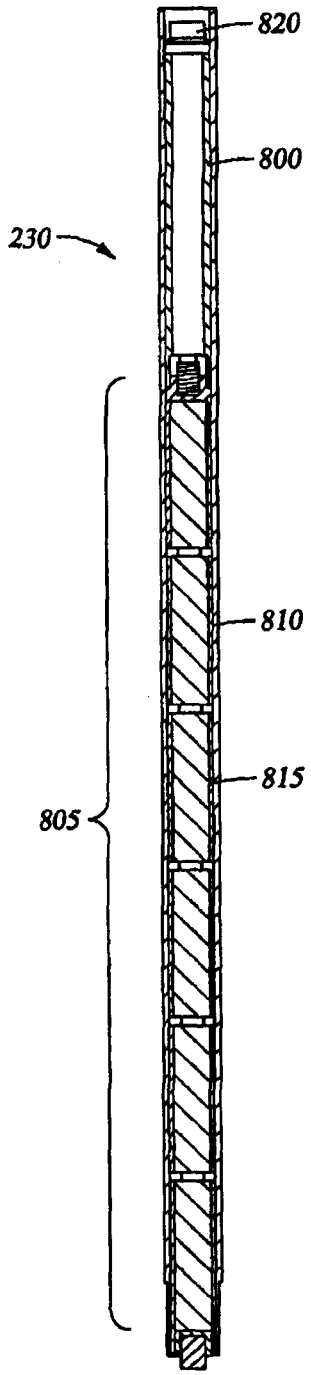
FIGS. 6A and 6B show side and front views, respectively, of the electronics package of the mud pulser tool of FIG. 2.

FIG. 6A shows electronics package 230. Electronics package 230 includes survey electronics 800 and power source 805. Electronics package 230 may provide a "dry" interior, e.g., the components are sealed from the mud flow through tool 20. Power source 805 may include any suitable power source for survey electronics 800, among other components of tool 20. Power source 805 may include battery cartridge 810 for housing one or more batteries 815. Batteries 815 may include lithium-ion batteries. Survey electronics 800 includes sensors, wireless or wired receivers and transmitters, processors, memory, or similar electronic components suitable for gathering, storing, receiving, transmitting and processing data. Survey electronics 800 may receive data or measurements from pressure transducer assembly 225 and process this data to determine a selected pressure drop. Electronics assembly 225 may include snubber 820 to protect the components of survey electronics 800, e.g., measurement devices. As shown in FIG. 5, pressure transducer assembly 225 and electronics assembly 230 are shaped to allow the assemblies to be stabbed together during assembly of sonde 255, and allow electrical connections 745 and 825 to be electrically connected.

Figure 6B:
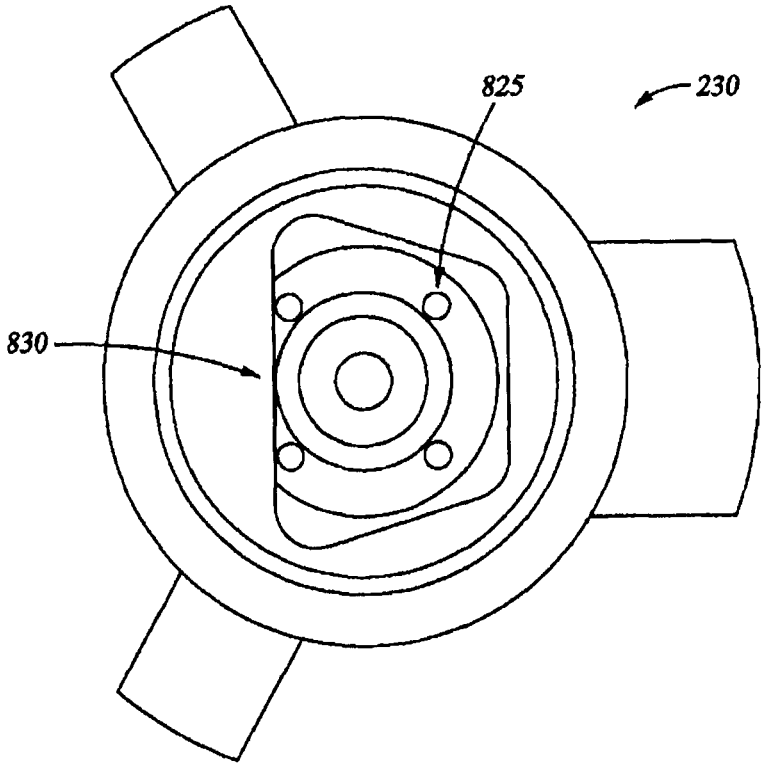

As shown in FIG. 6B, electronics package 230 may comprise electrical connector 825 for establishing an electrical connection path from power source 805 to motor assembly 220. Electronics assembly 230 may include one or more D-style keyed interfaces 830 to couple electronics assembly 230 to other modules in a manner that prevents electronics assembly 230 from rotating within housing 205 with respect to other modules, e.g., to maintain fixed orientation or alignment of survey electronics 800 in order to preserve the accuracy of orientation-based sensor measurements.

Figure 7:
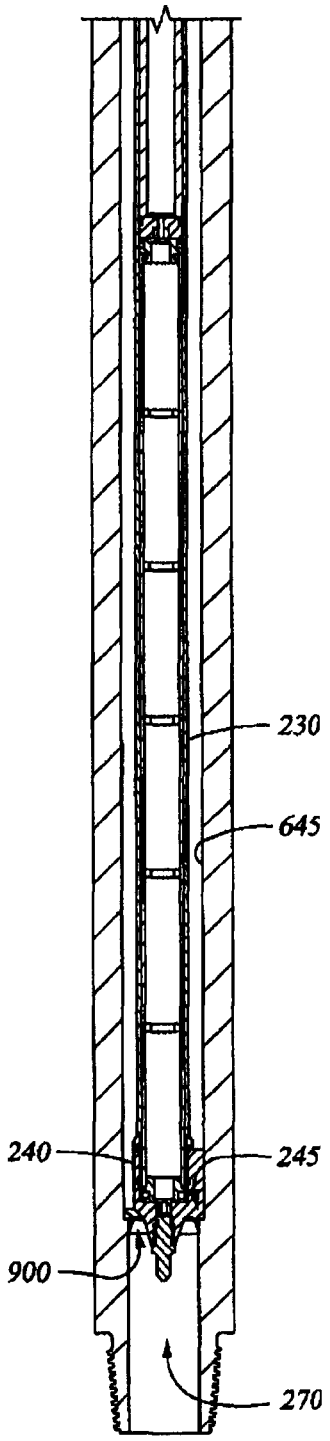
FIG. 7 shows the lower support assembly of the mud pulser tool of FIG. 2.

FIG. 7 shows electronics package 230 and an example of lower support 240. Electronics package 230 may be sized to accommodate channel 645 to allow mud flow to continue through tool 20. Lower support 240 couples to electronics 230 and shoulders against lip 245 to support sonde 255 (not shown in FIG. 7). Lower support 240 includes one or more ports 900 to allow mud flow through channel 645 to exit tool 20 via cavity exit 270.

During operation, tool 20 continuously provides real-time measurements of the pressure drop across tool 20 using upper pressure port assembly 210 and pressure transducer assembly 225. Electronics package 230 may take the real-time measurements and compare them to a reference or selected pressure drop that provides a desired signal-to-noise ratio for the mud pulse signal for selected or measured conditions. Electronics package 230 may then control motor assembly 220 to provide the necessary mud flow restriction to adjust the actual pressure drop to produce or maintain the selected pressure drop. As a result, tool 20 allows for closed loop control of the pressure drop to provide meaningful mud pulse signals across a wide variety of downhole conditions and depths.

Automatic adjustments of the pressure drop may also be based on depth. During no-flow periods, tool 20 may estimate the depth based on the absolute pressure measurement, e.g., based on hydrostatic pressure and not flow pressure. Once the depth is determined, tool 20 determines a selected pressure drop that is optimal for the measured depth in order to produce a pulse signal with the best signal-to-noise ratio at the surface that does not require a pressure difference that may cause damage or other undesirable conditions downhole. Electronics package 230 may store and/or utilize an algorithm or lookup table that correlates depth with desired pulse height. Electronics package 230 may take the depth data, reference the lookup table, determine the ideal pulse height, and then instruct motor assembly 220 to produce the necessary pressure drop across tool 20 to achieve the required pulse height.

Based on pressure differential measurements, electronics package 230 may determine whether mud pumps 35 are turned off and, if so, shut off motor assembly 220 or other components, in order to conserve battery power. Similarly, power may be conserved by turning off sensors when they are not needed. For example, tool 20 need not power up transducers 705 and 710 when it recognizes that it is on the surface. Tool 20 also includes a threadless, modular, bayonet-assembly-based design which is less expensive to fabricate, and easier to prepare, test and maintain than conventional collar mounted designs. Accordingly, the present invention provides an essentially unmanned tool that may reconfigure itself to maximize the signal-to-noise of its mud pulse signals through a closed loop control valve. Because of its design, the present invention provides a non-retrievable tool that is less likely to seize up or clog than conventional designs, e.g., only one control valve and poppet 605 may freewheel back into an open position so that mud flow may continue. Accordingly, the present invention is particularly fault tolerant of lost-circulation material (LCM). In addition, the use of a hydraulic channel minimizes the need for electronic connections to provide easier maintenance and assembly.

From the foregoing detailed description of specific examples of the invention, it should be apparent that a system and method for closed loop control of mud pulser pressure drop have been disclosed. Although specific examples of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed examples without departing from the spirit and scope of the invention as defined by the appended claims which follow.

What is claimed is:

1. A mud pulser tool to be positioned into a downhole environment, comprising:

a housing;

a control valve positioned in said housing that is selectively opened to allow a fluid to flow through the mud pulser tool or selectively closed to restrict the fluid flow, wherein the control valve is selectively opened or closed to produce a mud pulse signal transmitted through the fluid, said control valve comprising;

an orifice positioned in said housing; and a poppet actuated linearly relative to said orifice, wherein a distance between said poppet and orifice is adjustable;

a sensor system to measure a pressure drop across the control valve; and a control system coupled to said control valve, wherein said distance between said poppet and orifice is adjusted to achieve a desired differential pressure across said control valve, the mud pulser tool adjusts said distance between said poppet and orifice to produce a mud pulse signal with a selected pulse height, the mud pulser tool determines a depth at which the mud pulser tool is positioned within the downhole environment, and the selected pulse height is selected based on the depth.

2. The mud pulser of claim 1, wherein the control system produces a selected pressure drop across the control valve to produce a mud pulse signal with a selected signal-to-noise ratio.

3. The mud pulser tool of claim 1, wherein the sensor system further comprises:

a first pressure sensor operable to measure a pressure upstream of the control valve; and a second pressure sensor operable to measure a pressure downstream of the control valve, wherein the pressure drop across the control valve equals the difference between the upstream pressure measurement and the downstream pressure measurement.

4. The mud pulser tool of claim 3, wherein the first pressure sensor comprises, a first section positioned upstream of the control valve; and a second section positioned downstream of the control valve, wherein the first section and second section are connected by a hydraulic channel.

5. The mud pulser tool of claim 3, wherein the sensor system comprises an absolute pressure transducer.

6. The mud pulser tool of claim 3, wherein the sensor system comprises a differential pressure transducer.

7. The mud pulser tool of claim 3, wherein the mud pulser tool further comprises a collar;

a plurality of threadless modules to be mechanically coupled together into an assembly, wherein the assembly is positioned within the collar; and a retainer operable to couple with the collar and secure the assembly within the collar by compression.

8. A system for closed loop control of a mud pulser pressure drop, comprising:

a mud pump to pump drilling mud into a downhole environment;

a mud pulser tool to be positioned within the downhole environment, wherein the mud pulser tool comprises;

a control valve comprising an orifice and a poppet actuated linearly relative to said orifice, wherein a distance between said poppet and orifice is adjustable, and the control valve is selectively opened to allow the drilling mud to flow through the mud pulser tool or selectively closed to restrict the drilling mud flow;

a sensor system comprising pressure sensors to continuously measure a pressure drop across the control valve while the mud pulser tool is positioned within the downhole environment, wherein the sensor system measures the pressure drop across the control valve when the mud pump is not pumping fluid into the downhole environment to determine a current depth at which the mud pulser tool is positioned within the downhole environment; and a control system to selectively open or close the control valve to adjust the pressure drop to produce a selected pressure drop across the control valve to transmit a selected mud pulse signal through the drilling mud, wherein said distance between said poppet and orifice is adjusted to achieve said selected pressure drop across said control valve, said control system controls said distance between said poppet and orifice to adjust said pressure drop to produce a selected pulse height from said selected mud pulse signal, and the control system determines the selected pulse height based on the current depth; and a surface receiver device to receive the selected mud pulse signal.

9. The system of claim 8, wherein the sensor system further comprises a survey sensor operable to measure a selected property of the downhole environment; and wherein the survey sensor measures the selected property of the downhole environment at selected depths within the downhole environment.

10. The system of claim 9, wherein the mud pulser tool comprises a pulser motor assembly to selectively open and close the control valve, wherein the control system is coupled to the pulser motor assembly and selectively controls the pulser motor assembly;

wherein the mud pulser tool comprises a power source to provide electrical power to the pulser motor assembly; and wherein the control system restricts the operation of the pulser motor assembly when the mud pump is not pumping drilling mud into the downhole environment to conserve the power source.

11. The system of claim 10, wherein power source provides electrical power to the sensor system; and wherein the control system is operable to restrict the operation of the sensor system to conserve the power source.

12. A method for mud pulse telemetry comprising the steps of:

positioning a mud pulser tool comprising a flow restriction mechanism into a downhole environment, wherein the flow restriction mechanism comprises a poppet actuated linearly relative to an orifice, wherein a distance between said poppet and orifice is adjustable;

circulating fluid through the downhole environment during a first period of time;

measuring pressure upstream of a flow restriction mechanism during the first period of time;

measuring pressure downstream of the flow restriction mechanism during the first period of time; and obtaining a first differential pressure measurement from the upstream pressure measurement and the downstream pressure measurement;

determining a pulse height of the mud pulse signal necessary to allow the mud pulse signal to be received by a surface device from the current depth; and adjusting the configuration of the flow restriction mechanism to achieve a selected differential pressure to produce a selected mud pulse signal comprising the pulse height.

13. The method of claim 12, further comprising the step of adjusting a configuration of the flow restriction mechanism to achieve a selected differential pressure.

14. The method of claim 13, further comprising the steps of not pumping fluid into the downhole environment during a second period of time;

obtaining a hydrostatic pressure measurement during the second period of time; and estimating a current depth at which the mud pulser tool is positioned in the downhole environment based on the hydrostatic pressure measurement.

15. The method of claim 14, further comprising the steps of:

determining a signal to noise ratio of the mud pulse signal necessary to allow the mud pulse signal to be received by a surface device from the current depth; and adjusting the configuration of the flow restriction mechanism to achieve a selected differential pressure to produce a selected mud pulse signal comprising the signal to noise ratio.

16. The method of claim 14, further comprising the step of limiting energy consumption by the mud pulser tool during the second period of time.

17. The method of claim 14, further comprising the step of taking a survey of the downhole environment when the hydrostatic pressure measurement is a selected value.

18. The method of claim 17, further comprising the steps of:

determining a fluid density of the fluid for a selected depth; and determining a fluid flow rate through the flow restriction mechanism based on the fluid density and the first differential pressure measurement.

19. A method for mud pulse telemetry comprising the steps of:

positioning a mud pulser tool comprising a flow restriction mechanism into a downhole environment;

circulating fluid through the downhole environment during a first period of time;

measuring pressure upstream of a flow restriction mechanism during the first period of time;

measuring pressure downstream of the flow restriction mechanism during the first period of time;

obtaining a first differential pressure measurement from the upstream pressure measurement and the downstream pressure measurement;

adjusting a configuration of the flow restriction mechanism to achieve a selected differential pressure;

not pumping fluid into the downhole environment during a second period of time;

obtaining a hydrostatic pressure measurement during the second period of time;

estimating a current depth at which the mud pulser tool is positioned in the downhole environment based on the hydrostatic pressure measurement;

taking a survey of the downhole environment when the hydrostatic pressure measurement is a selected value;

determining a fluid density of the fluid for a selected depth; and determining a fluid flow rate through the flow restriction mechanism based on the fluid density and the first differential pressure measurement.

* * * * *

UNITED STATES PATENT AND TRADEMARK OFFICE

CERTIFICATE OF CORRECTION

PATENT NO. : 8,689,884 B2
APPLICATION NO. : 12/682553
DATED : April 8, 2014
INVENTOR(S) : Young et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 982 days.

Signed and Sealed this
Twenty-ninth Day of September, 2015

Michelle K. Lee

Michelle K. Lee
*Director of the United States Patent and Trademark Office*